US006318596B1

(12) United States Patent
Wiesner

(10) Patent No.: US 6,318,596 B1
(45) Date of Patent: Nov. 20, 2001

(54) PRODUCT DISPENSER

(76) Inventor: Douglas A. Wiesner, 3954 N. Bend Rd., Cincinnati, OH (US) 45211

( * ) Notice: Subject to any disclaimer, the term of this patent is extended or adjusted under 35 U.S.C. 154(b) by 0 days.

(21) Appl. No.: 09/595,756

(22) Filed: Jun. 16, 2000

(51) Int. Cl.[7] ..... B65D 35/28; B30B 3/02

(52) U.S. Cl. ..... 222/1; 222/101; 222/390; 100/210

(58) Field of Search ..... 222/1, 101, 102, 222/390; 100/156, 210, 289

(56) References Cited

U.S. PATENT DOCUMENTS

| | | | | |
|---|---|---|---|---|
| 3,232,488 | * | 2/1966 | Headberg | 222/101 |
| 3,954,205 | | 5/1976 | Williams | 222/100 |
| 4,010,873 | | 3/1977 | Mardirossian | 222/101 |
| 4,019,655 | * | 4/1977 | Moeller | 222/101 |
| 4,125,206 | | 11/1978 | Wilson | 222/101 |
| 4,160,513 | | 7/1979 | Cockerham | 222/181 |
| 4,223,809 | * | 9/1980 | Martin | 222/101 |
| 4,258,864 | | 3/1981 | Karamanolis et al. | 222/96 |
| 4,301,945 | | 11/1981 | Dworkin | 222/100 |
| 4,303,110 | | 12/1981 | Chen | 141/362 |
| 4,331,265 | * | 5/1982 | Warlick | 222/101 |
| 4,403,714 | * | 9/1983 | Kane | 222/101 |
| 4,424,916 | | 1/1984 | Pearson | 222/74 |
| 4,437,584 | | 3/1984 | Connors et al. | 222/137 |
| 4,450,982 | | 5/1984 | Ferreira | 222/93 |
| 4,508,239 | | 4/1985 | Rozzen | 222/39 |
| 4,570,829 | | 2/1986 | Allen | 222/181 |
| 4,600,126 | | 7/1986 | Arango | 222/82 |
| 4,629,095 | | 12/1986 | Smith | 222/96 |
| 4,688,700 | | 8/1987 | Guthrie | 222/94 |
| 4,793,526 | | 12/1988 | Webb | 222/391 |
| 5,048,725 | | 9/1991 | Peterson | 222/100 |
| 5,167,348 | | 12/1992 | Okami et al. | 222/103 |
| 5,203,473 | | 4/1993 | Willey | 222/94 |
| 5,230,444 | | 7/1993 | Dunbar | 222/181 |
| 5,271,529 | | 12/1993 | Stuber | 222/103 |
| 5,305,922 | | 4/1994 | Varon | 222/105 |
| 5,322,194 | | 6/1994 | Roberts | 222/103 |
| 5,323,931 | | 6/1994 | Robards, Jr. et al. | 222/96 |
| 5,323,932 | | 6/1994 | Bauman | 222/96 |
| 5,393,153 | | 2/1995 | Bouthillier et al. | 401/146 |
| 5,397,030 | | 3/1995 | Williams | 222/96 |
| 5,447,255 | | 9/1995 | Smedley | 222/102 |
| 5,577,640 | | 11/1996 | Albini et al. | 222/378 |
| 5,810,205 | | 9/1998 | Kohen | 222/103 |
| 5,813,572 | | 9/1998 | Kolacek | 222/107 |
| 5,845,813 | | 12/1998 | Werner | 222/101 |
| 5,868,282 | | 2/1999 | Imhoff | 222/101 |
| 5,875,929 | | 3/1999 | Nguyen | 222/102 |
| 5,884,512 | | 3/1999 | Stawowski | 222/100 |
| 5,887,754 | | 3/1999 | Wilkinson | 222/78 |
| 5,888,010 | | 3/1999 | Laux | 401/268 |
| 5,897,029 | | 4/1999 | Tong | 222/92 |
| 5,897,030 | | 4/1999 | Stangle | 222/103 |
| 5,920,967 | | 7/1999 | Souza | 24/563 |
| 5,957,334 | | 9/1999 | Rosario | 222/102 |
| 5,975,362 | | 11/1999 | West | 222/102 |

* cited by examiner

*Primary Examiner*—Kevin Shaver
*Assistant Examiner*—Stephanie L. Willatt
(74) *Attorney, Agent, or Firm*—Wood, Herron and Evans, L.L.P.

(57) ABSTRACT

A product dispenser for compelling a product from a container is provided having a frame with opposed end walls defining first and second axially aligned sockets and a dispensing hole. An drive member with first and second opposed ends is releasably engaged by the first and second sockets, respectively. A bearing member is adapted to travel between the first and second opposed ends of the drive member, whereby a deformable container holding a flowable product inserted into the frame expels the product through the dispensing hole under pressure exerted upon the container by the bearing member. The drive member is releasable from the frame and is re-engaged by the frame, whereby the first and second opposed ends are then releasably engaged by the second and first sockets, respectively. Therefore, after the bearing member has traveled from the first end to the second end, the bearing member may be repositioned within the frame to reinitiate travel towards the dispensing hole.

25 Claims, 2 Drawing Sheets

PRODUCT DISPENSER

FIELD OF THE INVENTION

This invention relates to product dispensers. More specifically, this invention relates to an improved product dispenser for compelling a product from a container.

BACKGROUND

Product dispensers for compelling a flowable product from a deformable container are known in the art and are generally seen in U.S. Pat. No. 4,125,206 issued to Wilson on a toothpaste dispenser; and U.S. Pat. No. 4,508,242 issued to Wolfe on a toothpaste extractor.

Certain prior art product dispensers include a screw or worm gear retained within a frame having a squeezing member received upon the screw to travel from a first end of the screw to a second end of the screw to compel a flowable product from a container. Once the squeezing member has reached the end of its travel at the second end of the screw, a user must actuate the squeezing member and, therefore, the screw in a reverse direction so that the squeezing member travels along the screw back towards the first end.

These prior art product dispensers require the squeezing member to travel along the length of the screw first to dispense product from a container and then reverse its direction along the screw without any work performed other than to return the squeezing member back to its origin. This requires unproductive time on the part of the user to reconfigure the dispenser for subsequent use. Further, this type of mechanism is inefficient and causes undue fatigue upon a user's fingers with manually actuated product dispensers and undue stress upon mechanical and electrical parts in an automatically actuated product dispenser, leading to accelerated mechanical and/or electrical failure of prior art product dispensers. In addition, these prior art product dispensers are generally complex in order to accommodate both forward and reverse travel of the squeezing member retained within the frame. These product dispensers have many moving parts and are not economical to manufacture or repair.

OBJECTIVE OF THE INVENTION

It has therefore been an objective of the present invention to provide an improved and relatively inexpensive apparatus to manufacture for compelling a product from its container.

It has been a further objective of the present invention to provide an apparatus for dispensing product from a container that is of simple and reliable construction.

It is another objection of the present invention to provide an apparatus for dispensing product from a container which is manually and efficiently operated and less prone to excessive wear and premature mechanical failure than prior art product dispensers.

SUMMARY OF THE INVENTION

These and other objectives of the present invention are achieved with a product dispenser which has a frame with opposed first and second end walls defining first and second sockets and a dispensing hole through which a container nozzle may be received. The first and second sockets are preferably axially aligned to receive an elongate drive member releasably engaged therein. The drive member has a bearing member threadably received thereupon positioned proximate the second end wall opposite the dispensing hole when in an initial position. A product container positioned within the frame is acted upon by a user forcing the bearing member to travel along the drive member towards the dispensing hole while bearing against the product container so as to compel the product from the container. Once the bearing member has reached a terminal position proximate the dispensing hole, the user may remove the drive member from the frame and thereafter re-engage the drive member within the frame so that the bearing member is once again at the initial position opposite the dispensing hole to allow a user to once again actuate travel of the bearing member towards the dispensing hole.

The present inventive product dispenser has very few moving parts, is simply constructed and manually operated, thereby reducing costs and enhancing ease of manufacture. A user compels product from a container by simple mechanical actuation of the bearing member traveling along the drive member and, once the container has been emptied, the user simply removes the drive member from the frame, turns it around, re-engages the drive member with the frame after a new product container has been inserted and continues to use the product dispenser without having to reverse travel of the bearing member along the drive member away from the dispensing hole.

The above and other objects and advantages of the present invention shall be made apparent from the accompanying drawings and the description thereof.

DETAILED DESCRIPTION

Figure 1:
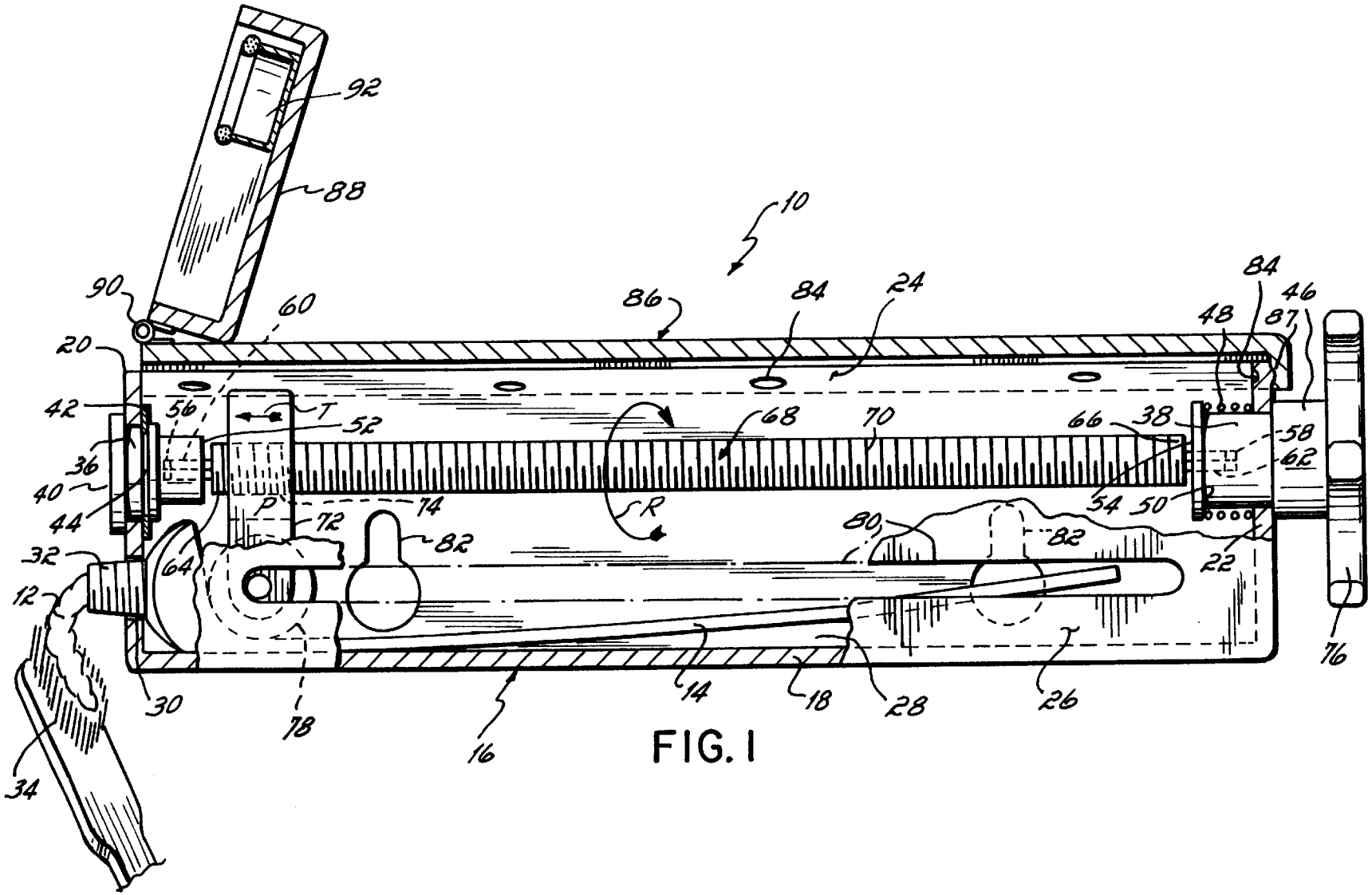
FIG. 1 is a partially cutaway side view of a product dispenser in accordance with the principles of the present invention.
Figure 2:
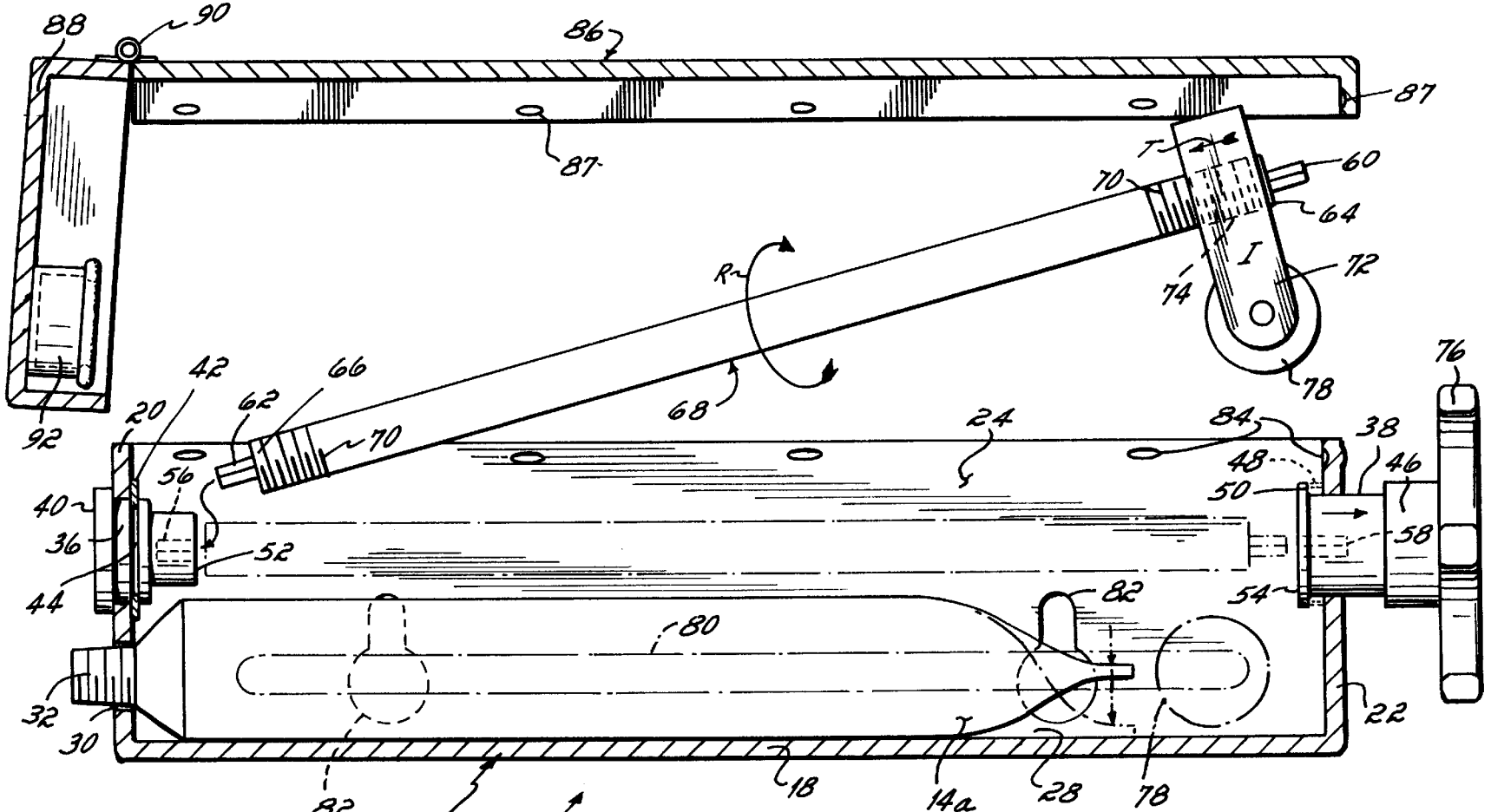
FIG. 2 is an exploded side view of the product dispenser of FIG. 1.

A presently preferred embodiment of the present inventive product dispenser 10 is seen in FIGS. 1 and 2. It will be understood by those in the art that while the product dispenser 10 as described herein is used to dispense toothpaste 12 from a toothpaste tube 14, the product dispenser 10 may be used to dispense any other desired flowable product from a deformable container suitable for use with the present invention.

The product dispenser 10 has a frame 16 with a base 18, first and second opposed end walls 20, 22 and first and second opposed side walls 24, 26. The first and second opposed end walls 20, 22 and first and second opposed side walls 24, 26 are preferably integral with the base 18 and define a cavity 28 in which the tube 14 is held. The first end wall 20 defines a dispensing hole 30 in which a tube nozzle 32 is positioned to dispense toothpaste 12 from the tube 14 upon a toothbrush 34.

The first and second opposed end walls 20, 22 have respective first and second opposed sockets 36, 38 which are preferably axially aligned.

The first socket 36 receives a first insert 40 therein which is secured in place by a washer 42 received in an insert groove 44 in order to prevent the first insert 40 from being pushed out of the first socket 36. The second socket 38 receives a second insert 46 therein and is resiliently retained in place by a biasing member, e.g., a spring 48, acting upon a circumferential bearing surface 50 in order to continually bias the second insert 46 against the second end wall 22. Preferably, the spring 48 allows a user to exert light force to pull the second insert 46 partially out of the second socket 38.

The first insert 40 and the second insert 46 have respective bearing surfaces 52, 54 and define respective pin holes 56, 58 therein. Received in pin holes 56, 58 are pins 60, 62 integral with respective first and second ends 64, 66 of an elongate drive member 68. The drive member 68 is of a screw or worm-type having threads 70. The drive member 68 carries a bearing member 72, preferably configured as a block, and defining a socket 74 through which the drive member 68 is threadedly received.

The second insert 46 includes an integral actuating member 76 which allows a user to rotate the second insert 46 and, therefore, the drive member 68 as indicated by arrow R. As the drive member 68 is rotated, the bearing member 72 travels from an initial position I proximate the first end 64 to a terminal position P proximate the second end 66 of the drive member 68 as indicated by arrow T. Once the bearing member 72 reaches the terminal position P proximate the second end 66 the toothpaste 12 has been expelled from the tube 14. The drive member 68 then may be disengaged from the frame 16, as seen in FIG. 2, by manually pulling the second insert 46 outwards against the second end 22 with actuating member 76, thereby disengaging the drive member 68 from the frame 16. Once the drive member 68 is disengaged from the frame 16, the tube 14 is removed from the cavity 28 and replaced by a second tube 14 full of toothpaste 12. The drive member 68 is thereafter re-engaged with the frame 16, whereby the second pin 62 on the second end 66 is received in the first pin hole 56 and the first pin 60 on the first end 64 may be received in the second pin hole 58, thus, repositioning the bearing member 72 at the initial position I without having to reverse rotation of the drive member 68. Once the drive member 68 has been re-engaged with the frame 16, the user once again turns the drive member 68 as indicated by arrow R in order to cause travel of the bearing member 72 towards the terminal position P to expel the toothpaste 12 from the second tube 14*a*.

In a preferred embodiment of the present invention, a roller 78 is carried by the bearing member 72 in order to travel over and exert pressure upon the tube 14 to compel toothpaste 12 out of the nozzle 32 and onto the toothbrush 34. A window 80 is advantageously defined in the first side 24 so that a user may monitor the travel of the bearing member 72 along the tube 14. The second side 26 advantageously defines eyelets 82 adapted to receive mounting studs (not shown), for example, nails or screws, therethrough to facilitate mounting of the frame 16 to a mounting surface (not shown) such as a bathroom wall or the like.

In another aspect of the present invention, the frame 16 includes embossments 84 in order to facilitate a friction fit between the frame 16 and a cover 86. The cover 86 includes dimples 87 which cooperate with embossments 84. The cover 86 preferably includes a lid 88 attached thereto with a hinge 90. The lid 88 includes a cap 92 which releasably seals the container nozzle 32 when the product dispenser 10 is not in use. The cap 92 is removable so that it may be cleaned or replaced as desired or required for health and safety considerations.

In use, the tube 14 holding toothpaste 12 is inserted into the frame 16 so that the nozzle 32 is positioned through the dispensing hole 30. The bearing member 72 is located at the first position I upon the drive member 68 with the first and second pins 60, 62 releasably received within first and second pin holes 56, 58, respectively. A user manually actuates the actuating member 76, rotating the drive member 68 as indicated by arrow R which causes the bearing member 72 to travel along the drive member 68 towards the dispensing hole 30. As the bearing member 72 travels along the drive member 68, the roller 78 deforms the tube 14 and compels toothpaste 12 out of the nozzle 32 onto the toothbrush 34.

Once the bearing member 72 reaches the terminal position P proximate the dispensing hole 30, the user removes the cover 86 from the frame 16 and pulls upon the actuating member 76 which draws the second insert 46 partially out of the second socket 38, thereby, disengaging the drive member 68. The user disengages the drive member 68 and bearing member 72 from pin holes 56, 58, and turns the drive member 68 around. The tube 14 is removed from the frame 16 and a second tube 14*a* is inserted in the cavity 28. The second tube 14*a* is positioned to expel toothpaste 12 through the dispensing hole 30 and the drive member 68 is thereafter re-engaged so that the second pin 62 is received within the first pin hole 56. The user then aligns the first pin 60 coaxially with the second pin hole 58 so that when the actuating member 76 is released and the second insert 46 is resiliently biased to its engaged position, the second pin hole 58 receives the first pin 60 therein. The bearing member 72 is thereby advantageously repositioned from its location upon drive member 68 proximate the dispensing hole 30 back to the second end 22 of the frame 16 without the user having to reverse motion of the actuating member 76 in order to move the bearing member 72 in a reverse direction along the drive member.

While he present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

Having described the invention, I claim:

1. A product dispenser for compelling a product from a container, comprising:

a frame having opposed first and second sockets and a dispensing hole;

an elongate drive member with first and second opposed ends having first and second pins, respectively, extending from the associated end, the first and second pins being similarly configured and releasably engaged by said first and second sockets, respectively, said drive member adapted to be disengaged from said frame and re-engaged with said frame, whereby said first and second pins are re-engaged so as to be releasably engaged by said second and first sockets, respectively; and a bearing member coupled to said drive member and adapted to travel in a first direction between said first and second sockets;

whereby when the container is positioned within the frame and upon actuation of the drive member the container expels the product through said dispensing hole under pressure exerted upon the container by said bearing member, after product is expelled, the first and second pins of the drive member are disengaged from the first and second sockets and re-engaged with the second and first sockets, respectively, to drive the bearing member in the first direction to dispense product from a second container.

2. The product dispenser of claim 1, comprising an actuating member releasably engaged with one of said first and second opposed sockets.

3. A product dispenser for compelling a product from a container, comprising:

a frame having opposed first and second sockets and a dispensing hole;

an elongate drive member with first and second opposed ends releasably engaged by said first and second sockets, respectively, said drive member adapted to be disengaged from said frame and re-engaged with said frame, whereby said first and second opposed ends are re-engaged so as to be releasably engaged by said second and first sockets, respectively;

a bearing member coupled to said drive member and adapted to travel in a first direction between said first and second sockets;

whereby when the container is positioned within the frame and upon actuation of the drive member the container expels the product through said dispensing hole under pressure exerted upon the container by said bearing member, after product is expelled, the first and second ends of the drive member are disengaged from the first and second sockets and re-engaged with the second and first sockets, respectively, to drive the bearing member in the first direction to dispense product from a second container;

an actuating member releasably engaged with one of said first and second opposed sockets; and a biasing member coupled to said actuating member for resiliently retaining said drive member within said frame;

wherein the biasing member is located within the frame and juxtaposed to one of the sockets.

4. The product dispenser of claim 2, wherein said actuating member is mounted to said second socket.

5. The product dispenser of claim 1, comprising opposed side walls defining a cavity in which the container is positioned, at least one of said side walls defining a window through which the container in said cavity is viewable.

6. The product dispenser of claim 5, wherein said sidewalls define an aperture adapted to mount said frame to a surface.

7. The product dispenser of claim 5, comprising a cover adapted to enclose said cavity.

8. The product dispenser of claim 7, wherein said cover is adapted to frictionally fit upon said frame.

9. The product dispenser of claim 1, comprising a lid adapted to overlay said dispensing hole.

10. The product dispenser of claim 9, wherein said lid is adapted to releasably seal said container.

11. The product dispenser of claim 1, wherein said bearing member further comprises a roller rotatably carried by said drive member and adapted to bear against the container.

12. The product dispenser of claim 1, wherein said bearing member is threadably coupled to said drive member.

13. A product dispenser for compelling a product from a container comprising:

a frame having opposed first and second end walls with first and second axially aligned sockets, and defining a dispensing hole and a cavity between said first and second end walls in which said container is positioned;

an elongate drive member with first and second opposed ends having first and second pins, respectively, extending from the associated end, the first and second pins being similarly configured and releasably engaged within said first and second sockets, respectively, said drive member adapted to be disengaged from said frame and re-engaged with said frame, whereby said first and second pins are re-engaged so as to be releasably engaged by said second and first sockets, respectively;

a bearing member threadably coupled to said drive member and adapted to travel in a first direction between said first and second sockets;

a roller rotatably carried by said drive member and adapted to bear against the container;

whereby when the container is positioned within said frame and in communication with the dispensing hole, the roller engages the container and upon actuation of said drive member expels the product through said dispensing hole under pressure exerted upon the container by said roller after product is expelled, the first and second pins of the drive member are disengaged from the sockets and re-engaged with the second and first sockets, respectively, to drive the bearing member and roller in said first direction to compel product from a second container; and an actuating member releasably coupled to said second socket and resiliently retained by said frame.

14. The product dispenser of claim 13, comprising opposed side walls, at least one of said side walls defining a window through which the container in said cavity is viewable and a mounting aperture.

15. The product dispenser of claim 13, comprising:

a cover to enclose said cavity and adapted to frictionally fit upon said frame; and a lid pivotally attached to said cover and adapted to overlay said end wall to releasably seal said container.

16. A product dispenser for compelling a flowable product from a deformable container comprising:

a frame having opposed first and second end walls and first and second opposed side walls defining a cavity, said first and second end walls defining first and second coaxially aligned sockets and a dispensing hole, and said first and second opposed side walls defining a window to view into said cavity and a mounting aperture;

a threaded elongate drive member with first and second opposed ends having first and second pins, respectively, extending from the associated end, the first and second pins being similarly configured and releasably engaged by said first and second sockets, respectively, said drive member adapted to be disengaged from said frame and re-engaged by said frame, whereby said first and second opposed pins are re-engaged with said frame so as to be releasably engaged by said second and first sockets, respectively;

a bearing member defining a threaded socket coupled to said drive member and adapted to travel in a first direction between said first and second opposed ends of said drive member, said bearing member carrying a roller, whereby when the container is positioned within the frame and in communication with the dispensing hole, the roller engages the container and upon actuation of the drive member expels the product through said dispensing hole under pressure exerted upon the container by said roller after product is expelled, said first and second pins of said drive member are disengaged from said first and second sockets and re-engaged with said second and first sockets, respectively, to drive said bearing member in said first direction to dispense product from a second container, and the travel of said bearing member is viewable through said window;

an actuating member releasably coupled to one of said first and second opposed ends to allow a user to cause said bearing member to travel along said drive member;

a biasing member coupled to said actuating member for resiliently retaining said drive member within said frame; and a cover adapted to frictionally fit upon said frame to enclose said cavity, including a lid pivotally attached to said cover for releasably sealing said container.

17. A method for compelling a flowable product from a deformable container, comprising the steps of:

inserting the deformable container into a cavity of a frame having first and second sockets and a dispensing hole;

positioning the deformable container within said cavity to expel the flowable product through the dispensing hole;

locating an elongate drive member having first and second opposed ends in said frame so that said first end is releasably engaged by said first socket and said second end is releasably engaged by said second socket;

actuating a bearing member coupled to said drive member to travel along said elongate drive member towards said dispensing hole;

deforming the deformable container with said bearing member to thereby compel the product from the container and through said dispensing hole;

disengaging said drive member from said frame;

removing said container from said frame;

inserting a second deformable container into said cavity;

positioning said second container to expel product through said dispensing hole; and re-engaging said first end with said second socket and said second end with said first socket to subsequently compel the product from said second container.

18. The method of claim 17, comprising the step of releasably sealing the container with a lid adapted to overlay said dispensing hole.

19. The method of claim 17, comprising the steps of:

manually operating an actuating member attached to one of said first and second sockets; and rotating said drive member.

20. The method of claim 19, comprising the steps of:

biasing said actuating member in contact with said drive member;

pulling said biased actuating member away from said drive member; and releasing said biased actuating member back into contact with said drive member.

21. The dispenser of claim 16 wherein the biasing member is located within the frame and juxtaposed to one of the sockets.

22. A method for compelling a flowable product from a container, comprising the steps of:

inserting the container into a cavity of a frame having a dispensing hole;

positioning the container within said cavity to expel the flowable product through the dispensing hole;

mounting an elongate drive member having first and second opposed ends in said frame so that said elongate drive member is releasably and operationally mounted within said frame with said first end proximate said dispensing hole;

actuating a bearing member coupled to said drive member to travel along said elongate drive member towards said dispensing hole;

expelling the product from the container and through said dispensing hole with the bearing member;

removing said drive member from said frame;

removing said container from said frame;

inserting a second container into said cavity;

positioning said second container to expel product through said dispensing hole;

re-orienting said elongate drive member; and re-mounting said re-oriented elongate drive member in said frame so that said second end is proximate said dispensing hole.

23. The method of claim 22 further comprising:

expelling the product from the second container and through said dispensing hole with the bearing member.

24. The method of claim 22 wherein the re-orienting further comprises pivoting the elongate drive member approximately 180°.

25. The method of claim 22 wherein the mounting and re-mounting steps each further comprise:

inserting the first and second ends of the elongate drive member into sockets in the frame.

* * * * *